US009221264B2

(12) United States Patent
Takeuchi et al.

(10) Patent No.: US 9,221,264 B2
(45) Date of Patent: Dec. 29, 2015

(54) IMAGE FORMING APPARATUS AND DROPLET DISCHARGE DETECTOR

(71) Applicants: Shotaro Takeuchi, Kanagawa (JP); Shingo Masaoka, Kanagawa (JP); Masahiko Hisada, Kanagawa (JP); Kyohei Matsumura, Kanagawa (JP)

(72) Inventors: Shotaro Takeuchi, Kanagawa (JP); Shingo Masaoka, Kanagawa (JP); Masahiko Hisada, Kanagawa (JP); Kyohei Matsumura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/328,897

(22) Filed: Jul. 11, 2014

(65) Prior Publication Data

US 2015/0062223 A1 Mar. 5, 2015

(30) Foreign Application Priority Data

Sep. 4, 2013 (JP) ..... 2013-183482

(51) Int. Cl.
*B41J 2/165* (2006.01)
*B41J 29/17* (2006.01)

(52) U.S. Cl.
CPC ..... *B41J 2/16579* (2013.01); *B41J 29/17* (2013.01)

(58) Field of Classification Search
CPC ..... B41J 29/38; B41J 29/393; B41J 2/165; B41J 2/16579; B41J 2/16535; B41J 2/04558; B41J 2/0456; B41J 2/16541; B41J 2/0451
USPC ..... 347/14, 19, 33
See application file for complete search history.

(56) References Cited

U.S. PATENT DOCUMENTS

| | | | | |
|---|---|---|---|---|
| 4,768,045 | A * | 8/1988 | Koto | 347/19 |
| 2005/0030332 | A1* | 2/2005 | Masuda | 347/19 |
| 2010/0245462 | A1* | 9/2010 | Seino et al. | 347/28 |
| 2013/0286092 | A1* | 10/2013 | Sambhy et al. | 347/36 |
| 2014/0132668 | A1 | 5/2014 | Takeuchi | |

FOREIGN PATENT DOCUMENTS

| | | |
|---|---|---|
| JP | 1-297253 | 11/1989 |
| JP | 2004-306475 | 11/2004 |
| JP | 2007-050533 | 3/2007 |
| JP | 2010-173270 | 8/2010 |

OTHER PUBLICATIONS

Christopher M. A. Brett, Lucio Angnes, Hans-Dieter Liess, "Carbon Film Resistors as Electrodes: Voltametric Properties and Application in Electroanalysis," Electroanalysis, vol. 12, Issue 8-9, pp. 765-769, May 2001.*

* cited by examiner

*Primary Examiner* — Geoffrey Mruk
*Assistant Examiner* — Scott A Richmond
(74) *Attorney, Agent, or Firm* — Cooper & Dunham LLP

(57) ABSTRACT

An image forming apparatus is provided, that includes a recording head including a plurality of nozzles to discharge droplets; and a droplet discharge sensor unit to detect whether a droplet has been discharged from the plurality of nozzles of the recording head or not. The droplet discharge sensor unit includes a resistor, on which the droplets discharged from the nozzles of the recording head lands, the resistor disposed opposite the recording head; and a sensor to detect a change in electrical resistance of the resistor when the droplets discharged from the plurality of nozzles of the recording head landed on the resistor.

9 Claims, 26 Drawing Sheets

IMAGE FORMING APPARATUS AND DROPLET DISCHARGE DETECTOR

CROSS-REFERENCE TO RELATED APPLICATIONS

The present application claims priority pursuant to 35 U.S.C. §119(a) from Japanese patent application number 2013-183482, filed on Sep. 4, 2013, the entire disclosure of which is incorporated by reference herein.

BACKGROUND

1. Technical Field

Exemplary embodiments of the present invention relate to an image forming apparatus and a droplet discharge detector.

2. Background Art

As an image forming apparatus such as a printer, a facsimile machine, a copier, a plotter, and a multifunction apparatus combining several of the capabilities of the above devices, for example, an inkjet recording apparatus of a droplet discharging recording method employing a print head to discharge an ink droplet is known.

Among the inkjet recording apparatuses, there is provided an inkjet recording apparatus including a discharge detector to detect a state of discharging droplets from an inkjet head. In the event that a defective nozzle from which droplet is not discharged properly is detected, the defective nozzle is cleaned.

As a known droplet detector, a droplet is discharged from the recording head to a recording liquid receiving means having a potential difference from the potential of the head, and electrical change when the droplet is deposited on the recording liquid receiving means is measured, thereby detecting whether or not there exists a droplet discharge.

In addition, it is known that the recording liquid receiving means having a potential difference from the potential of the head is wiped by a wiping means in a same direction as a moving direction of a carriage.

However, in the method of detecting whether the discharge is present by detecting potential difference, because the droplet is affected by an electric field generated by the recording liquid receiving means having a potential difference from that of the head, the detection output when the droplet discharge impacts the recording liquid receiving means is weakened, and thus, detection errors increase.

SUMMARY

In one embodiment of this disclosure, there is provided an image forming apparatus, that includes a recording head including a plurality of nozzles to discharge droplets; and a droplet discharge sensor unit to detect whether a droplet has been discharged from the plurality of nozzles of the recording head or not. The droplet discharge sensor unit includes a resistor, on which the droplets discharged from the nozzles of the recording head lands, the resistor disposed opposite the recording head; and a sensor to detect a change in electrical resistance of the resistor when the droplets discharged from the plurality of nozzles of the recording head landed on the resistor.

In one embodiment of this disclosure, there is provided a droplet discharge sensor unit for an image forming apparatus having a recording head including a plurality of nozzles, in which the droplet discharge sensor unit detects whether a droplet has been discharged from the plurality of nozzles of the recording head or not and includes a resistor on which the droplets discharged from the plurality of nozzles of the recording head lands. The droplet discharge sensor unit detects a change in electrical resistance of the resistor when the droplets discharged from the plurality of nozzles of the recording head landed on the resistor.

These and other objects, features, and advantages of the present invention will be apparent upon consideration of the following description of the preferred embodiments of the present invention when taken in conjunction with the accompanying drawings.

DETAILED DESCRIPTION

Hereinafter, preferred embodiments of the present invention will now be described with reference to accompanying drawings.

Figure 1:
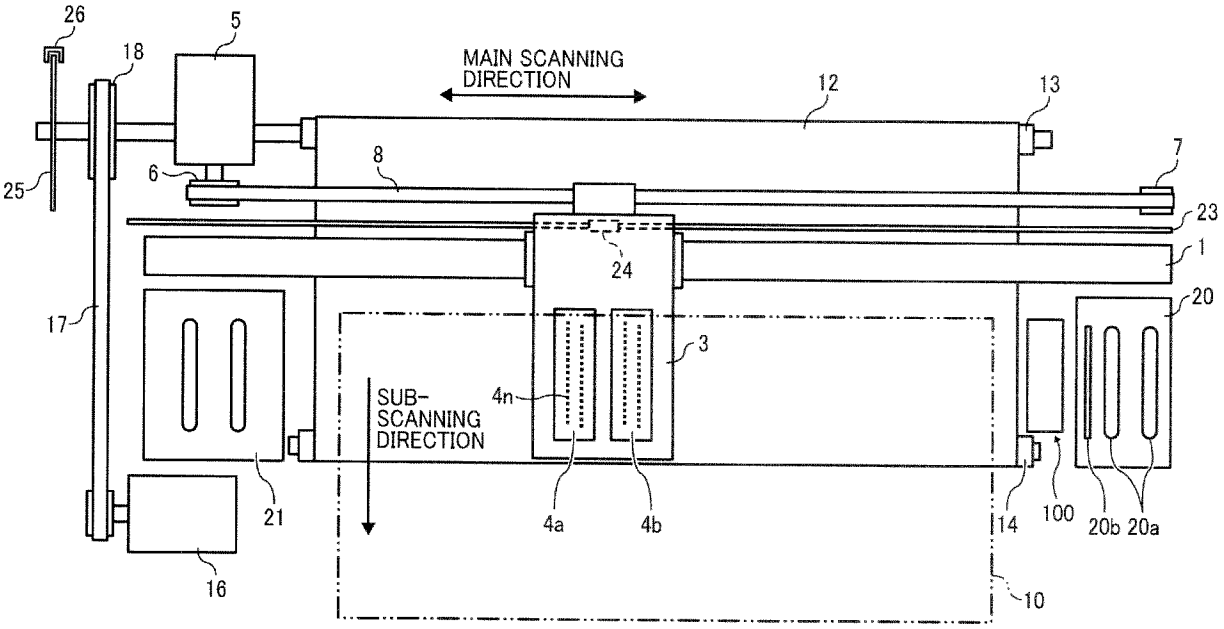
FIG. 1 is a plan view of an image forming apparatus illustrating an exemplary mechanical portion according to an embodiment of the present invention.

First, an example of an image forming apparatus to which an embodiment of the present invention is applied will be described with reference to FIG. 1. FIG. 1 is a plan vies illustrating a structural portion of the image forming apparatus.

This image forming apparatus is a serial-type inkjet recording apparatus including lateral side plates (not shown), a main guide 1, a sub guide (not shown), and a carriage 3. The carriage 3 is movably held by the main and sub guides both horizontally held on the side plates. The image forming apparatus further includes a main scanning motor 5, a driving pulley 6, a driven pulley 7, and a timing belt 8. The main scanning motor 5 moves the carriage 3 in a main scanning direction or a carriage moving direction via the timing belt 8 stretched between the driving pulley 6 and the driven pulley 7.

Recording heads 4*a*, 4*b* each formed of a liquid discharge head are mounted on the carriage 3. The recording heads may be referred to as the recording heads 4 when indiscriminately used in the present embodiment. The recording heads 4 discharge ink droplets of each color of yellow (Y), cyan (C), magenta (M), and black (K). The recording heads 4 include nozzle arrays formed of a plurality of nozzles arranged in a sub-scanning direction perpendicular to the main scanning direction, with the ink droplet discharging direction oriented downward.

Figure 2:
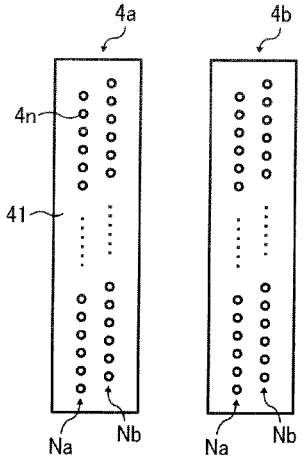
FIG. 2 illustrates recording heads included in the image forming apparatus of FIG. 1.

As illustrated in FIG. 2, the recording heads 4 each include two nozzle arrays Na, Nb. One of the nozzle arrays Na of the recording head 4*a* discharges droplets of black (K) and the other discharges droplets of cyan (C) ink. Similarly, one of the nozzle arrays of the recording head 4*b* discharges droplets of magenta (M) and the other discharges droplets of yellow (Y), respectively.

For the liquid discharge head forming the recording heads 4, for example, a piezoelectric actuator that employs a piezoelectric element, or a thermal actuator that uses a phase change due to film boiling of a liquid employing thermoelectric conversion elements such as a thermal resistor, may be used.

To convey a sheet of paper 10 (to be referred to simply as a sheet, hereinafter), a conveyance belt 12 serving as a conveyance means to electrostatically attract and convey the sheet 10 to a position opposed to the recording heads 4 is provided. The conveyance belt 12 is an endless belt entrained around the conveyance roller 13 and the tension roller 14.

The conveyance belt 12 is caused to rotate in the sub-scanning direction driven by rotation of the conveyance roller 13 via a timing belt 17 and a timing pulley 18 driven by a sub-scanning motor 16. The conveyance belt 12 is, while rotatably moving, charged by a charger, not shown.

Further, a maintenance unit 20 to maintain the recording heads 4 in good condition is disposed at one side of the conveyance belt 12 and at one side in the main scanning direction of the carriage 3. On the other side, a dummy discharge reservoir 21 to receive discharged droplets in the dummy discharging operation from the recording heads 4 is disposed at the other side of the conveyance belt 12.

The maintenance unit 20 includes, for example, a cap member 20*a* to cap a nozzle face (i.e., a surface on which the nozzle is formed) of the recording head 4; a wiper 20*b* to clean the nozzle face; and a dummy discharge receiver to receive droplets not contributing to the image formation.

In addition, a droplet discharge sensor unit 100 is disposed outside a recording area between the conveyance belt 12 and the maintenance unit 20 and opposite the recording heads 4.

An encoder scale 23 disposed along the main scanning direction of the carriage 3 is stretched between the two side plates. The encoder scale 23 includes a predetermined pattern. The carriage 3 includes an encoder sensor 24 formed of a transmission-type photo sensor to read a pattern of the encoder scale 23. A linear encoder or a main scanning encoder to detect moving of the carriage 3 is thus formed of the encoder scale 23 and the encoder sensor 24. (Thus, the encoder sensor 24 may also be referred to as the main scanning encoder sensor 24.)

A code wheel 25 is disposed on a shaft of the conveyance roller 13. A pattern is formed on the code wheel 25. An encoder sensor 26 formed of a transmission-type photosensor is provided to detect the pattern formed on the code wheel 25. The code wheel 25 and the encoder sensor 26 together form a rotary encoder (or a sub-scanning encoder) to detect a displacement position and amount of the conveyance belt 12. (The encoder sensor 26 may also be referred to as the sub-scanning encoder sensor 26.)

In the thus-configured image forming apparatus, the sheet 10 is fed out from a paper tray, not shown, and is conveyed on and attracted to the charged conveyance belt 12. The sheet 10 is conveyed in the sub-scanning direction by the cyclic rotation of the conveyance belt 12.

Then, the recording heads 4 are driven in response to image signals while moving the carriage 3 in the main scanning direction, to thus discharge ink droplets onto the stopped sheet 10 to record a single line. After the sheet 10 is conveyed a predetermined distance, a next line is recorded. Upon receiving a recording end signal or a signal indicating that a trailing edge of the sheet 10 has reached the recording area, the recording operation is terminated and the sheet 10 is ejected to a sheet discharge tray.

Figure 3:
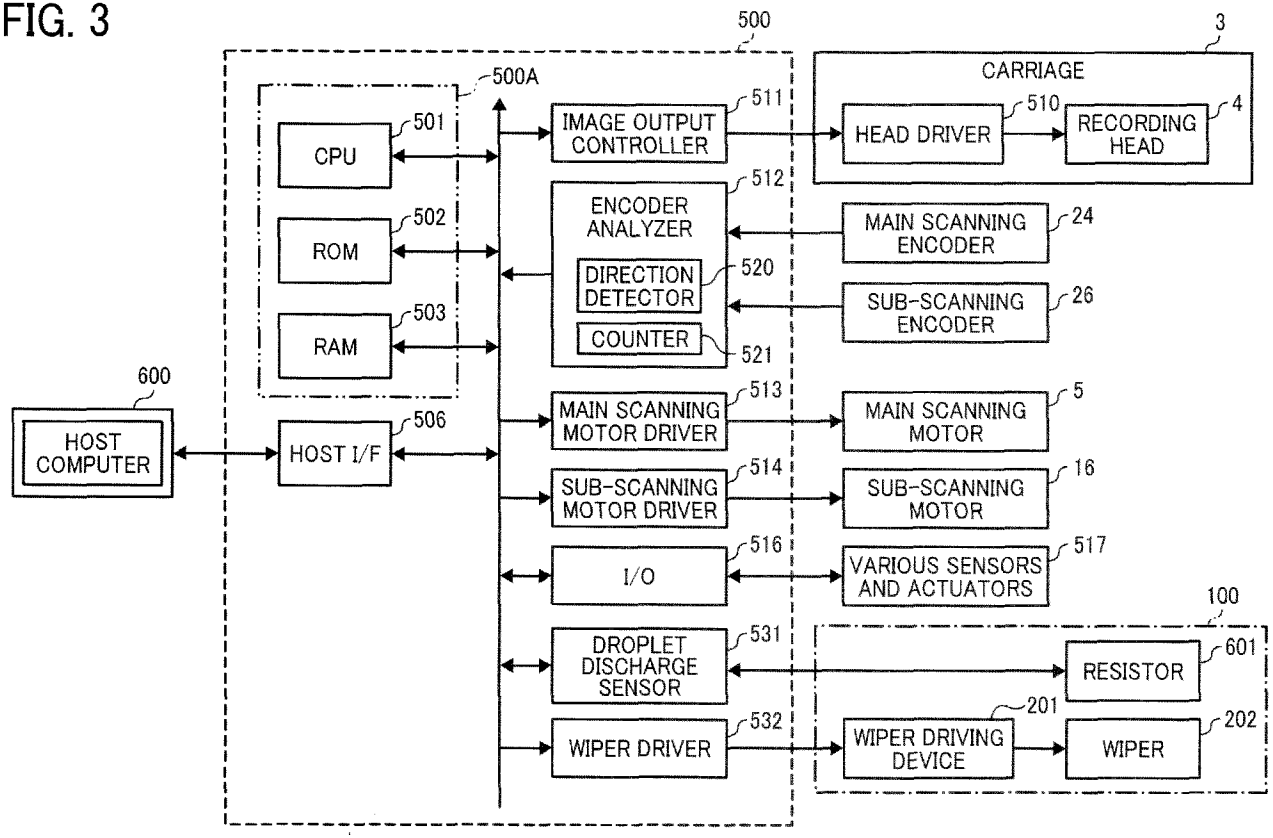
FIG. 3 is a block diagram relating to a control circuit of the image forming apparatus of FIG. 1.

Next, an outline of a controller in the image forming apparatus will be described with reference to FIG. 3. FIG. 3 is a block diagram of the control circuit 500.

The control circuit 500 includes a main controller 500A including: a CPU 501 serving to control the apparatus entirely; various programs performed by the CPU 501; a read-only memory (ROM) 502 storing various fixed data; and a random access memory (RAM) 503 temporarily storing image data.

The control circuit 500 further includes a host I/F 506 serving to transmit data to and from a host computer 600 such as a PC; an image output controller 511 to control driving of the recording heads 4; and an encoder analyzer 512. The encoder analyzer 512 receives detection signals from the main scanning encoder sensor 24 and the sub-scanning encoder sensor 26 and analyses them.

The control circuit 500 further includes a main scanning motor driver 513 to drive the main scanning motor 5; a sub-scanning motor driver 514 to drive the sub-scanning motor 16; various sensors and actuators 517; and an I/O 516 to transfer data with the various sensors and actuators 517.

The control circuit 500 further includes a droplet discharge sensor 531 and the droplet discharge sensor unit 100. The droplet discharge sensor 531 detects a change in electrical resistance when the droplet lands on a resistor 601 of the droplet discharge sensor unit 100 and determines whether the droplet is discharged or not. The control circuit 500 further includes a wiper driver 532 to drive a wiper driving device 201 that moves a wiper 202. The wiper 202 cleans the resistor 601 of the droplet discharge sensor unit 100.

The image output controller 511 includes a data generator to generate print data, a driving waveform generator to generate a driving waveform to control driving of the recording heads 4, a data transferor to transfer a head control signal for selection of a predetermined drive signal from the driving waveform, and the print data. The image output controller 511 further includes a head driver 510 which is a head driving circuit to drive the recording heads 4 mounted on the side of the carriage 3. The image output controller 511 outputs driving waveforms, head control signals, and print data to the head driver 510, to cause the recording heads 4 to discharge droplets corresponding to the print data from the nozzles.

The encoder analyzer 512 includes a direction detector 520 to detect a moving direction of the carriage 3 and a counter 521 to detect a shifting amount of the carriage 3.

The control circuit 500 controls driving of the main scanning motor 5 via the main scanning motor driver 513 based on the analyzing result of the encoder analyzer 512, to control moving of the carriage 3. In addition, the control circuit 500 controls conveyance of the sheet 10 by controlling driving of the sub-scanning motor 16 via the sub-scanning motor driver 514.

When performing detection of the droplet discharge from the recording heads 4, the main controller 500A of the control circuit 500 causes the recording heads 4 to move and have the predetermined nozzles thereof discharge droplets; and determines the droplet discharge status by the detection signal from the droplet discharge sensor 531.

Figure 4:
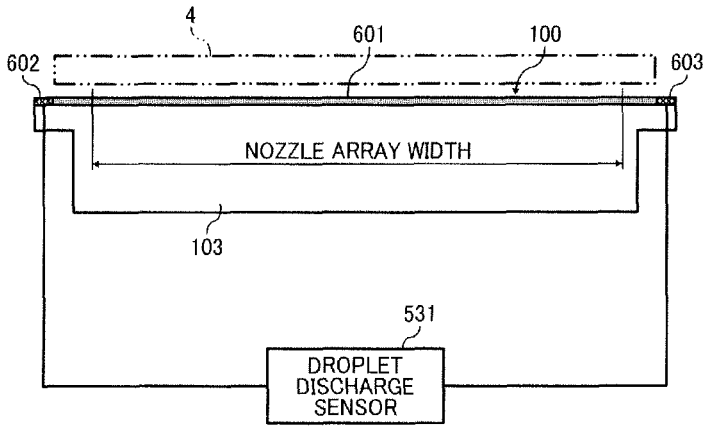
FIG. 4 is a side view illustrating a droplet discharge sensor unit in a first embodiment of the present invention.
Figure 5:
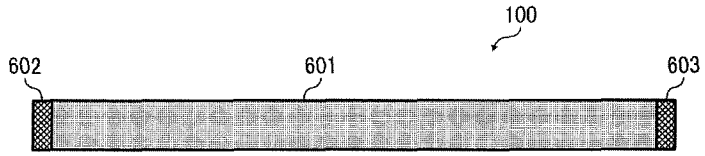
FIG. 5 is a plan view of the droplet discharge sensor unit of FIG. 4.

Next, referring to FIGS. 4 and 5, the droplet discharge sensor device according to a first embodiment of the present invention will be described. FIG. 4 is a side view of the droplet discharge sensor unit, and FIG. 5 is a plan view of the same.

The droplet discharge sensor device includes the droplet discharge sensor unit 100 and the droplet discharge sensor 531.

The droplet discharge sensor unit 100 includes the resistor 601 on an upper surface of a holder member 103 opposed to the nozzle face 41 of the recording heads 4. The resistor 601 has a length sufficient to receive droplets ejected from any of the nozzles 4*n* (see FIG. 2) in the nozzle alignment direction.

An electrode 602 (or electrode A) and an electrode 603 (or electrode B) are connected to both longitudinal ends of the resistor 601, respectively.

Herein, the resistor 601 is preferably formed of materials for a resistor employed in the potentiometer, for example. Preferred materials include cermet and carbon film.

Considering ink resistance and anti-abrasion property against wiping operation after the droplet discharge detection, the resistor 601 should be formed of a material with a stiffness stronger than that of the wiper member, and thus a carbon film resistor is more preferable.

Further, the surface of the resistor 601 is preferably waterproofed.

The holder member 103 is formed of electrically insulating materials such as plastic.

Further, the electrode 602 and the electrode 603 are connected to the droplet discharge sensor 531. The droplet discharge sensor 531 detects changes in the resistance of the resistor 601 between the electrode 602 and the electrode 603 and from that change (if any) determines whether the droplet has been discharged or not.

As such, the change in the resistance of the resistor 601 can be detected as a change of the resistance between the two electrodes 602 and 603 each disposed at a longitudinal end of the resistor 601. At this time, because the two electrodes 602 and 603 are disposed outside the two end-nozzle positions, respectively, the droplet discharge detection can be performed on all of the nozzles.

Figure 7:
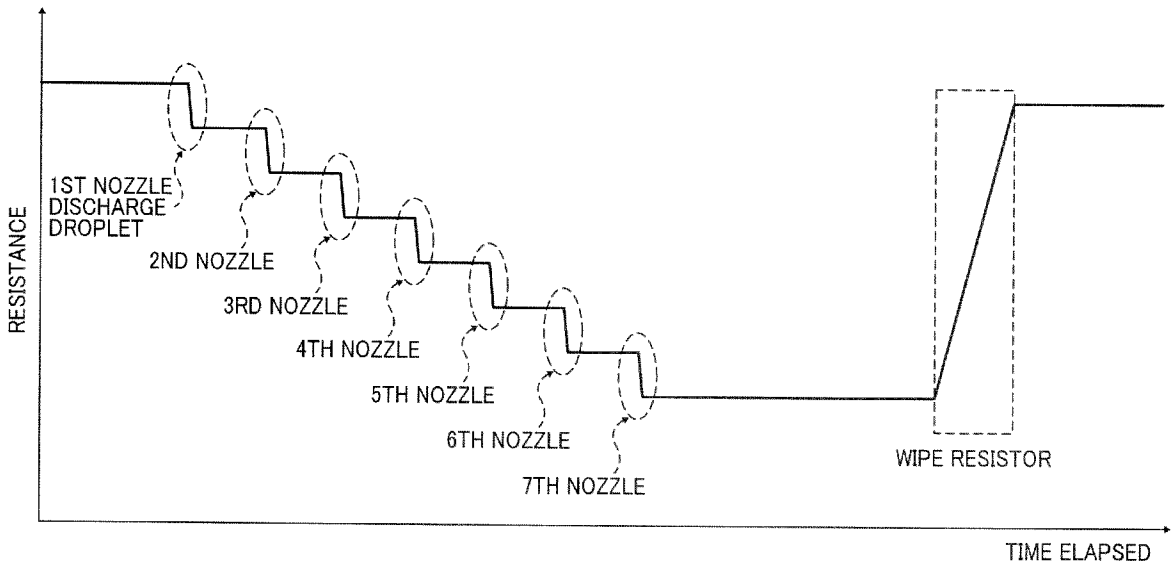
FIG. 7 is an explanatory view showing an example of change in resistance of a resistor when there is no nozzle that does not discharge droplets.
Figure 8:
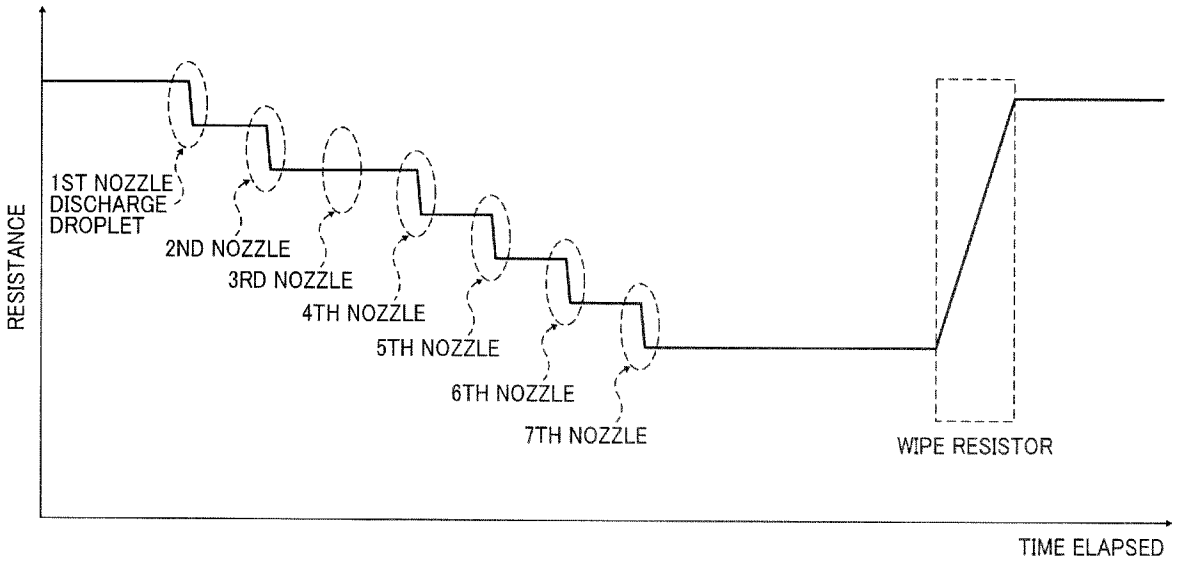
FIG. 8 is an explanatory view showing an example of change in resistance of the resistor when there is a nozzle that does not discharge droplets.

Next, the droplet discharge detection in the thus-configured droplet discharge sensor unit will be described with reference to FIGS. 6 through 8. FIGS. 6A to 6C are explanatory views illustrating how to detect droplet discharge. FIGS. 7 and 8 are explanatory views each showing an example of change in the resistance of the resistor. In FIGS. 7 and 8, the examples each show a case in which the number of nozzles is seven.

Figure 6A:
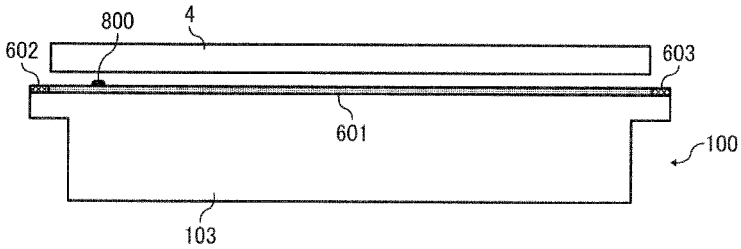
FIGS. 6A to 6C are views illustrating droplet discharge detection.

First, when the recording heads 4 are faced to the droplet discharge sensor unit 100 and a droplet 800 is discharged from a first nozzle 4*n* of the recording heads 4 as illustrated in FIG. 6A, because the droplet 800 is electrically conductive, the resistance of the resistor 601 (that is, the resistance between the electrode 602 and the electrode 603) decreases.

Figure 6B:
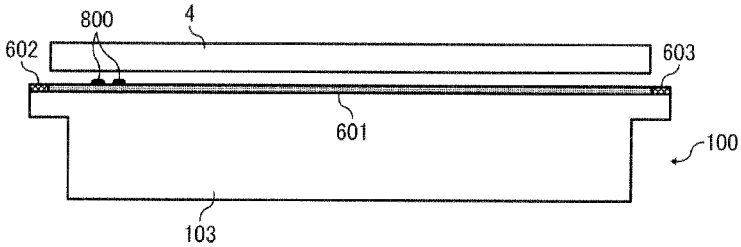
Figure 6C:
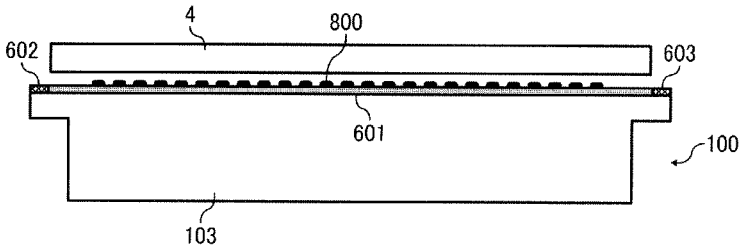

Similarly, as illustrated in FIG. 6B, when a droplet 800 is discharged from a second nozzle 4*n* of the recording heads 4 as illustrated in FIG. 6B, the resistance of the resistor 601 further decreases. Similarly, as illustrated in FIG. 6C, the droplet is discharged from all nozzles 4*n* of the recording heads 4.

Thus, as illustrated in FIG. 7, when the droplet is discharged sequentially and normally from the seven nozzles 4*n* of the recording heads 4, the resistance of the resistor 601 decreases each time the droplet lands on the resistor 601.

By contrast, for example, as illustrated in FIG. 8, when the droplet is not discharged from a third nozzle, even though the third nozzle is driven to discharge a droplet, the resistance does not change.

Accordingly, when it is detected that the resistance does not change by detecting the change in the resistance of the resistor 601, it is determined that the subject nozzle does not discharge droplets, that is, the subject nozzle is defective.

In the two cases of FIGS. 7 and 8, the droplet is wiped by a wiper, not shown, after the droplet discharge detection, the resistance of the resistor 601 is returned to an initial value or a slightly lowered value.

Figure 9:
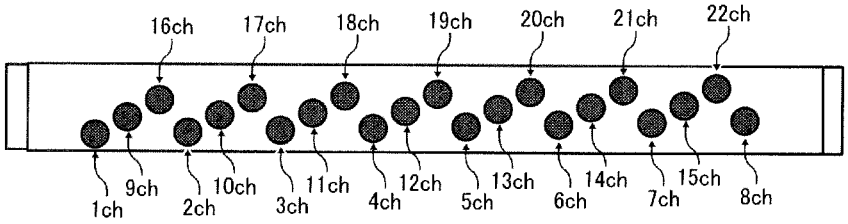
FIG. 9 shows a plan view illustrating an exemplary order of the droplet discharge when detecting discharges from each nozzle in nozzle arrays.

Next, referring to FIG. 9, an example of an order of a droplet discharge when the droplet discharge detection of the nozzle arrays is performed will be described. FIG. 9 shows a plan view illustrating an order of the droplet discharge. Herein, 22 nozzles are disposed in one array with the leftmost nozzle in FIG. 9 set as the first (1ch), and the rightmost nozzle as the 22nd (22ch). Black dots in FIG. 9 represent droplets landed on the resistor 601 and the numbers 1 to 22 (1ch to 22ch in the figure) show an order in which the droplets are discharged from the nozzle.

In the example as illustrated in FIG. 9, the leftmost nozzle is denoted as "1ch", and the rightmost nozzle as "22ch". The order of discharge is therefore as follows: 1ch to 4ch, 7ch, 10ch, 13ch, 16ch, 19ch, 22ch, 2ch, 5ch, 8ch, 11ch, 14ch, 17ch, 20ch, 3ch, 6ch, 9ch, 12ch, 15ch, 18ch, and 21ch. While the droplet discharge is performed according to the above order, the carriage 3 is moved in the main scanning direction, so that the droplets discharged from adjacent nozzles do not contact each other.

When the nozzles disposed at intervals are sequentially detected, detection output is high and detection precision is improved compared to the droplet detection for the adjacent nozzles. Further, the detection output becomes higher and the detection result is more accurate when the droplets discharged from the different nozzles do not contact each other.

When the droplet discharge sensor unit detects the change in the resistance, detecting not only whether the droplet has been discharged or not, but detection of a volume of the discharged droplet or a droplet speed may be performed.

Figure 10:
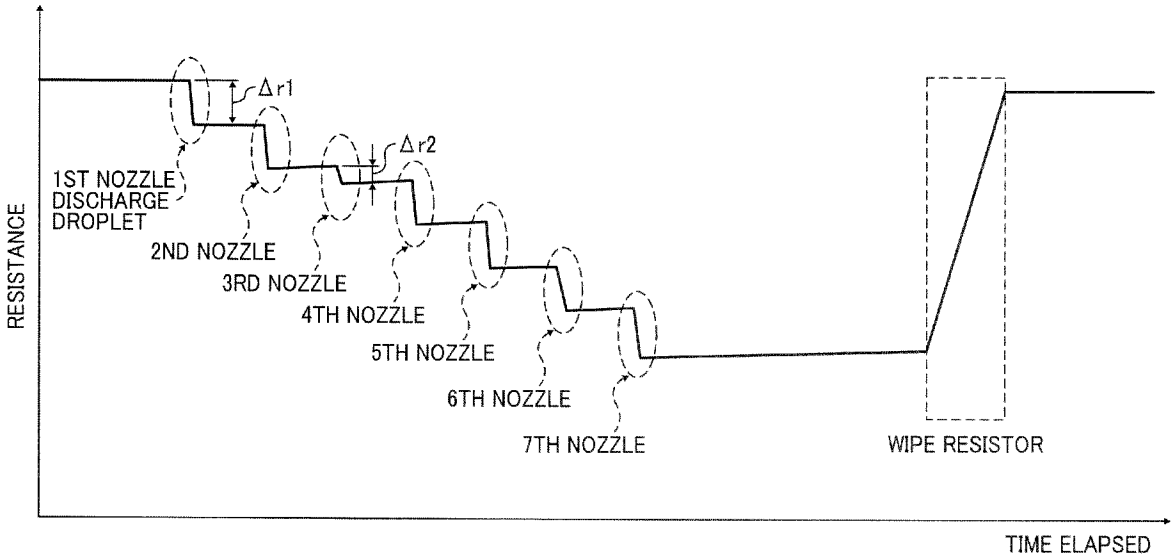
FIG. 10 is a view illustrating an example of change in resistance of the resistor to explain how to detect a droplet volume.

Next, the droplet volume detection by the droplet discharge sensor unit will now be described with reference to FIG. 10. FIG. 10 is an explanatory view illustrating how to detect a change in the resistance of the resistor for use in explaining how to detect the droplet volume.

In the example as illustrated in FIG. 10, a change in the resistance $\Delta r2$ when the droplet is discharged from the third nozzle is less than the change $\Delta r1$ when the droplet is discharged from the other nozzles. This means that a volume of the droplet discharged from the third nozzle is small. Specifically, the change in the resistance of the resistor 601 is depending on the volume of the droplet landed on the resistor 601.

As a result, by detecting the change in the resistance of the resistor 601, it is possible to detect the volume of the discharged droplet and the nozzle can be treated properly in accordance with the detected droplet volume.

If the droplet volume is below a predetermined threshold, when driving the nozzle that jets a droplet with a volume less than the threshold, a stronger drive waveform is used to allow the droplet having a larger droplet volume to be discharged by, for example, increasing the driving voltage.

Alternatively, the nozzle that jets a droplet with a volume less than the threshold alone is caused to discharge a dummy discharge droplet, which does not contribute to image formation.

Further alternatively, when the number of nozzles that eject a droplet with a volume less than the threshold is greater than a threshold number, nozzles are cleaned.

Thus, by detecting the droplet volume from the change in the resistance of the resistor, a high-quality image can be formed consequently.

Figure 11:
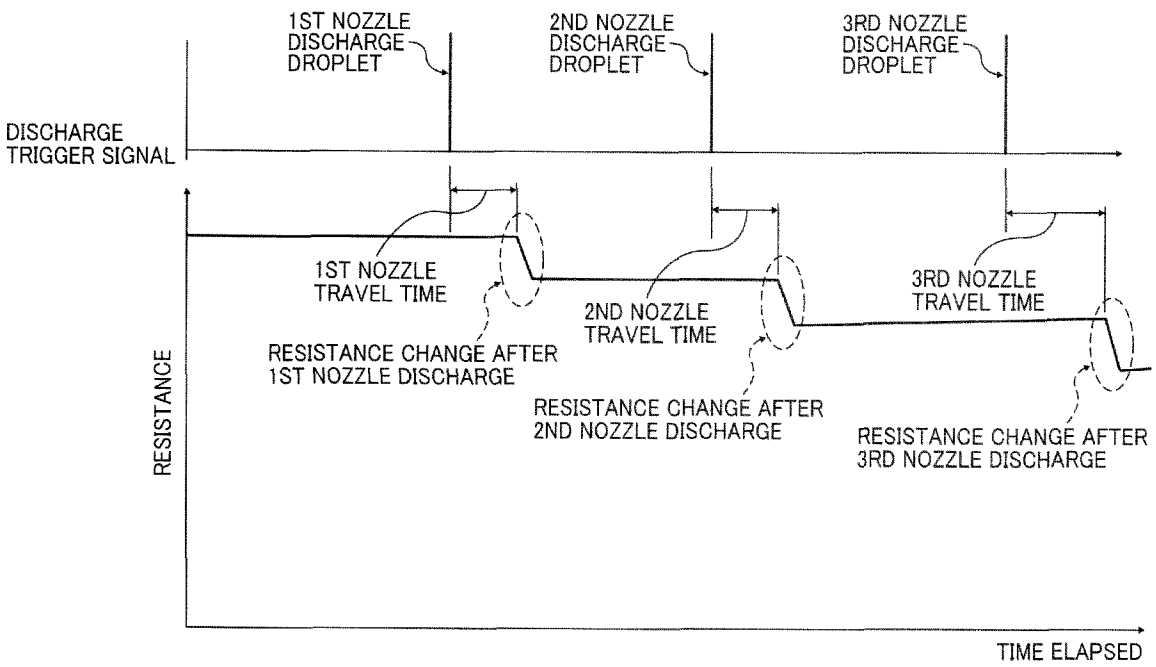
FIG. 11 is an explanatory view illustrating an example of a droplet discharge timing and the change in resistance for use in detecting a droplet speed.

Next, referring to FIG. 11, detection of the droplet speed using the droplet discharge sensor unit 100 will be described, FIG. 11 is an explanatory view illustrating an example showing a droplet discharge timing and the change in the resistance.

As illustrated in FIG. 11, a length of time from when the droplet discharges until the change in the resistance is detected changes according to the droplet speed. Then, because the droplet speed can be obtained based on the time period from the droplet discharge until the change in the resistance is detected, the nozzles can be treated properly, after the detection operation, in accordance with the droplet speed.

For example, if the droplet speed of a certain nozzle is slower than the predetermined threshold, the droplet discharge timing of the subject nozzle is accelerated. If the number of nozzles having the droplet speed that is slower than the predetermined threshold becomes greater than the predetermined number, the control circuit 500 allows the maintenance operation to be performed. Thus, by detecting the droplet speed from the change in the resistance of the resistor, a higher quality image can be formed.

Figure 12:
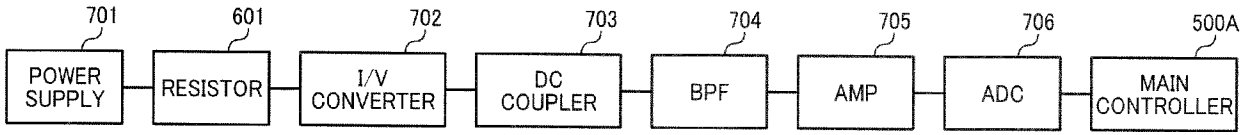
FIG. 12 is a block diagram illustrating a first example of the droplet discharge sensor according first embodiment.
Figure 13:
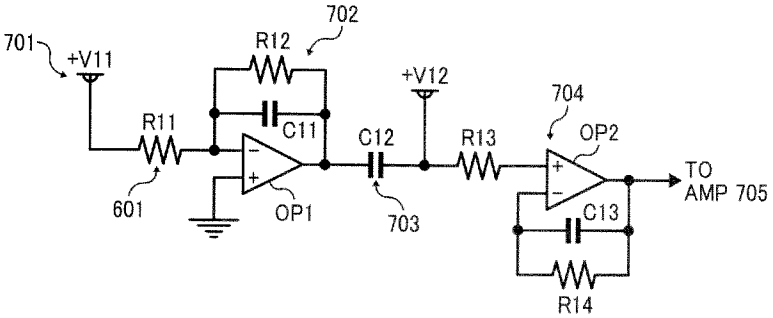
FIG. 13 is a block diagram specifically illustrating part before an amplifier in FIG. 12.

Next, referring to FIGS. 12 and 13, a first example of the droplet discharge sensor device according to the first embodiment of the present invention will be described. FIG. 12 is a block diagram illustrating the first example of the droplet discharge sensor; and FIG. 13 is a circuit diagram more specifically illustrating part before an amplifier 705.

The resistor 601 on which droplets for detecting the droplet discharge from the recording heads 4 landed is connected to the droplet discharge sensor 531. The droplet discharge sensor 531 applies a voltage (5 volts, for example) from a power supply 701 to portions between the electrodes 602 and 603 disposed at both ends of the resistor 601 (see FIG. 4). The power supply 701 is controlled to be turned on and off by the main controller 500A.

The droplet discharge sensor device further includes an I/V converter 702 to convert, from current to voltage, an electrical change when the droplet lands on the resistor 601, a DC coupler 703 to input the I-V converted signal, a bandpass filter (BPF) 704, the amplifier (AMP) 705 to amplify signals, and an AD converter (ADC) 706 to perform analog-to-digital conversion on the amplified signal.

Then, the conversion result by the ADC 706 is input to the main controller SODA.

In a specific example as illustrated in FIG. 13, the power supply 701 is formed of +V11; the resistor 601 is a resistor R11; the I/V converter 702 is formed of an OP amplifier OP1, a resistor R12, and a capacitor C11; the DC coupler 703 is formed of a capacitor C12; and the BPF 704 includes an OP amplifier OP2, resisters R13 and R14, and a capacitor C13.

The droplet discharge sensor 531, in discharge detection, causes the recording heads 4 to discharge one or plural droplets from each nozzle. In this case, because the discharged droplet is a conductive member having a resistance, electrical resistance between the electrode 602 as the electrode A and the electrode 603 as the electrode B minutely changes.

Then, the I/V converter 702 converts electric current flowing through the resistor 601 to a voltage, and the DC coupler 703 increases the voltage to an appropriate level to obtain a changed amount of the voltage alone. The amplifier 705 amplifies the changed voltage, the ADC 706 performs A/D conversion, and the obtained measurement result is input to the main controller 500A.

The main controller SODA determines whether or not the measurement result exceeds the predetermined threshold. If the measurement result exceeds the threshold, the main controller 500A determines that the nozzle discharges the droplet. If the measurement result does not exceed the threshold, the main controller 500A determines that the nozzle does not discharge the droplet.

In the present embodiment, because each nozzle is caused to discharge droplets to the resistor 601, determination of whether the droplet is discharged from the nozzle takes time ranging from 0.5 to 10 msec. When determination of the nozzle with regard to proper or defective discharge, that is, droplet discharged or not discharged, is complete, voltage applied to the resistor 601 is turned off.

Figure 14:
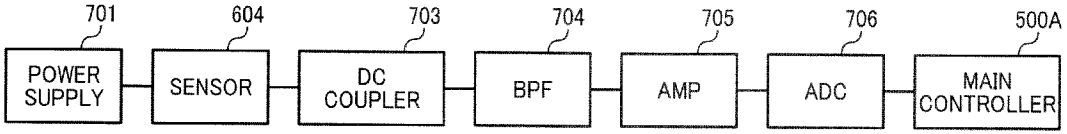
FIG. 14 is a block diagram illustrating a second example of the droplet discharge sensor.

Next, referring to FIGS. 14 and 15, a second example of the droplet discharge sensor device will be described. FIG. 14 is a block diagram illustrating the second example of the droplet discharge sensor; and FIG. 15 is a circuit diagram more specifically illustrating the part prior to the amplifier as illustrated in FIG. 14.

In the second example, differently from the first example, a detector 604 is composed of a series circuit of the resistor 601 and another resistor R22 connected in series. Voltage is applied to the detector 604 from the power supply 701, and the voltage signal obtained at a node "a" between the resistor 601 and the resistor R22 is directly input to the DC coupler 703 as is.

Figure 15:
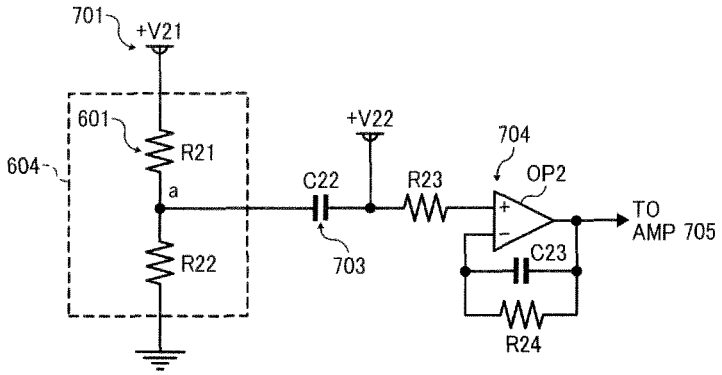
FIG. 15 is a block diagram more specifically illustrating the part prior to the amplifier as illustrated in FIG. 14.

In the specific example as illustrated in FIG. 15, the power supply 701 is formed of +V21; the resistor 601 is a resistor R21; the DC coupler 703 is formed of a capacitor C22; and the BPF 704 includes the OP amplifier OP2, the resistors R13 and R14, and a capacitor C23.

Figure 16:
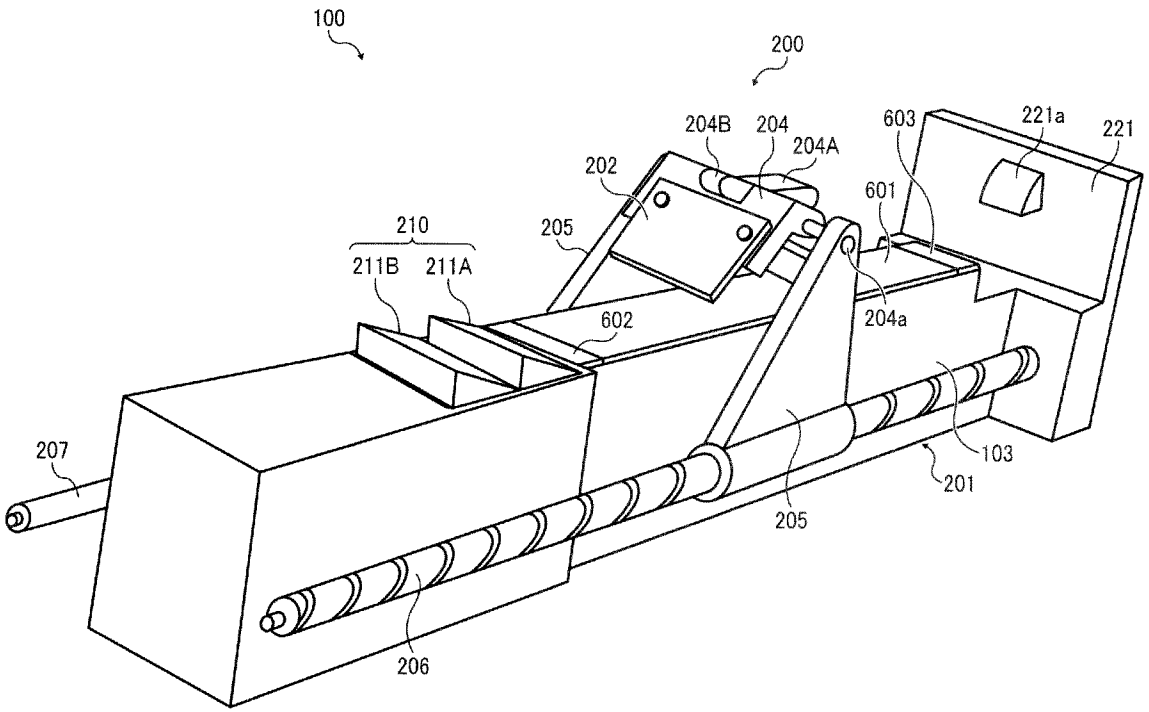
FIG. 16 is a perspective view of the droplet discharge sensor unit according to a second embodiment of the present invention.
Figure 17:
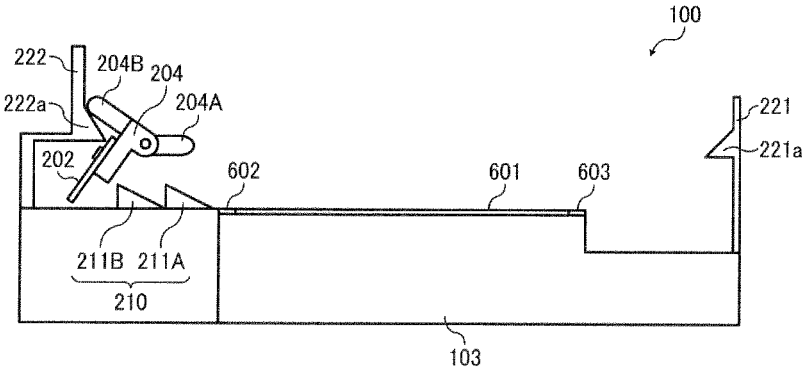
FIG. 17 is a side view of the droplet discharge sensor unit when a wiper at a home position, that is, at a wiping end position.
Figure 18:
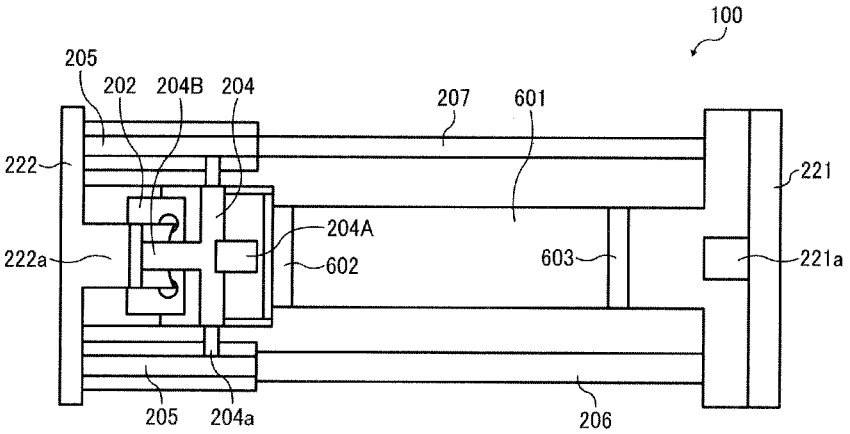
FIG. 18 is a plan view of the droplet discharge sensor unit when the wiper is at the home position as in FIG. 17.

Next, the droplet discharge sensor unit in the second embodiment according to the present invention will be described with reference to FIGS. 16 through 18. FIG. 16 is a perspective view of the droplet discharge sensor unit 100, FIG. 17 is a side view of the droplet discharge sensor unit 100 when the wiper is at a home position after wiping is finished, and FIG. 18 is a plan view of the same when the wiper is at the home position as in FIG. 17.

Similarly to the first embodiment, the droplet discharge sensor unit 100 includes the resistor 601 disposed on an upper face of the holder member 103 opposite the nozzle face 41 of the recording heads 4, and the resistor 601 includes electrodes 602 and 603 disposed on its lateral ends in the nozzle array alignment direction. Further, the surface of the resistor 601 which the droplet lands on is waterproofed.

In addition, there is provided a cleaning unit 200 including the wiper 202 to wipe away the droplet or wasted droplet adhered on the surface of the resistor 601.

The cleaning unit 200 includes a holder 204 to hold the wiper 202. Both sides 204*a* of the holder 204 are rotatably held by a slider member 205. A convex portion 204A is disposed on one side in the nozzle alignment direction, that is, in the sub-scanning direction, and a convex portion 204B is disposed on another side thereof.

A lead screw 206 is disposed along the longitudinal direction of the resistor 601 in the nozzle alignment direction. The slider 205 on one side engages the lead screw 206 and the slider 205 on another side is rotatably held by a guide shaft 207.

Then, the lead screw 206 is rotated by a driving motor, not shown, so that the slider 205 reciprocally moves along the longitudinal direction of the resistor 601.

A wall 221 as a first contact member is built at one end of the holder member 103 and at the side from which wiping starts. The wall 221 includes a contact portion 221*a* that contacts the convex portion 204A of the holder 204.

The convex portion 204A of the holder 204 contacts the contact portion 221*a* and the convex portion 204A bounces up, so that the holder 204 is moved to a first position in which the wiper 202 is brought to a posture to wipe the resistor 601.

Another wall 222 as a second contact member is built at another end of the holder member 103 at which the wiping ends as illustrated in FIGS. 17 and 18. The wall 222 includes a contact portion 222*a* that contacts the convex portion 204B of the holder 204.

The convex portion 204B of the holder 204 contacts the contact portion 222*a* and the convex portion 204B bounces up, so that the holder 204 moves to a second position in which the wiper 202 is separated from the resistor 601.

A wiper cleaner 210 is a cleaner to remove waste liquid adhered on the wiper 202. The wiper cleaner 210 is disposed at another end of the holder member 103, that is, at the side where the wiping is finished.

The wiper cleaner 210 is formed of absorbers 211A and 211B disposed at the side where the wiping is finished, along the nozzle alignment direction.

Herein, a relation between lengths of each part will be described.

A length D of a diameter of the droplets discharged from the recording heads 4 and landed on the resistor 601, the width L1 of the resistor 601 in the direction perpendicular to the nozzle alignment direction, the width L2 of the wiper 202 in the same direction as above, and the width L3 of the absorber 211 in the same direction as above satisfy a relation: $D<L1<L2<L3$.

As a result, the wiper 202 can wipe the resistor 601 securely and the waste liquid adhered on the wiper 202 can be securely absorbed by the absorber 211.

In addition, the surface of the resistor 601 is better waterproofed than the surface of the wiper 202. Specifically, a receding contact angle of the surface of the resistor 601 is greater than that of the surface of the wiper 202.

With this configuration, the resistor 601 is wiped without leaving any part not wiped away.

Next, an effect of the thus-configured droplet discharge sensor unit 100 will be described with reference to FIGS. 19A through 24C. FIGS. 19A-B and 20A-B are plan views illustrating effects of the droplet discharge sensor unit 100, and FIGS. 21 to 24C are side views illustrating the same.

Figure 19A:
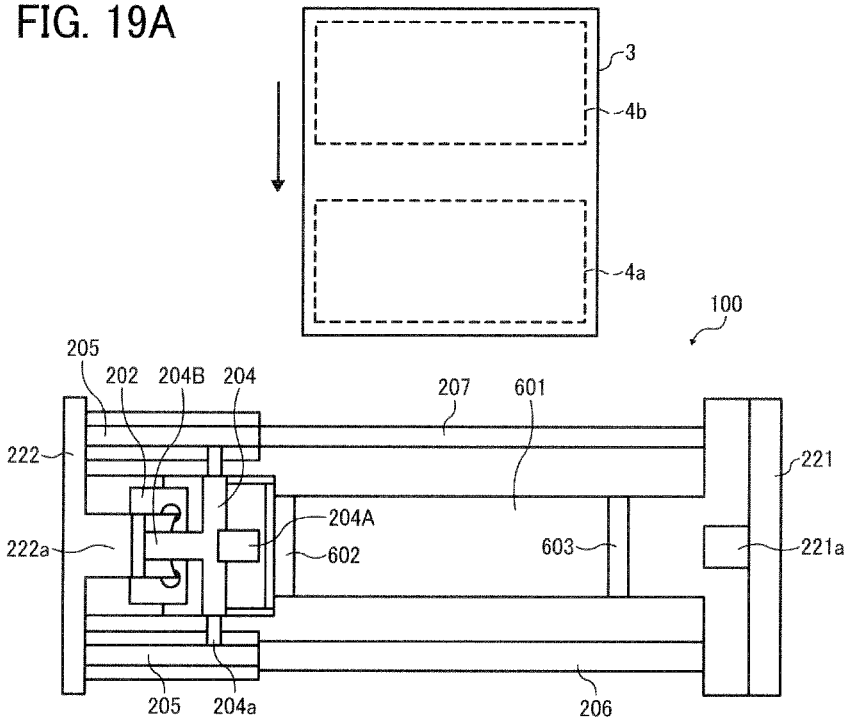
FIGS. 19A and 19B are plan views illustrating effects of the droplet discharge sensor unit.
Figure 19B:
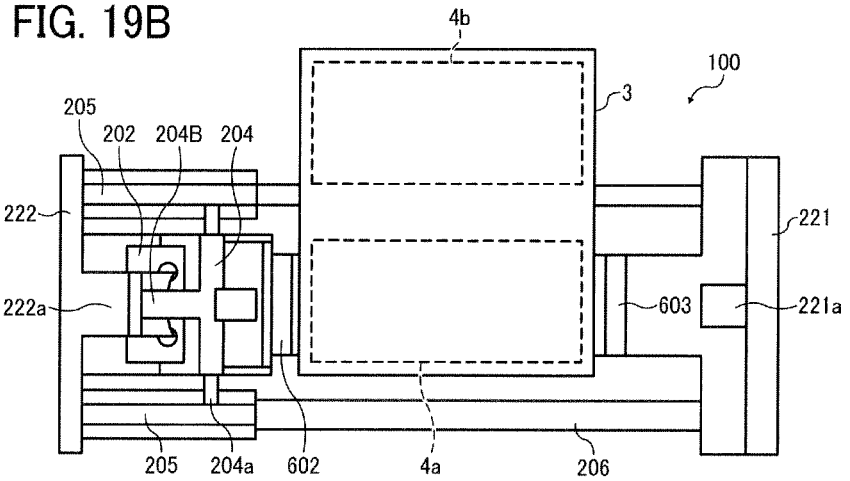

First, the carriage 3 is moved as illustrated in FIG. 19A, and the recording head 4*a* is opposed to the resistor 601 of the droplet discharge sensor unit 100 as illustrated in FIG. 19B. Then, each nozzle of the recording head 4*a* is detected for the droplet discharging property.

Figure 20A:
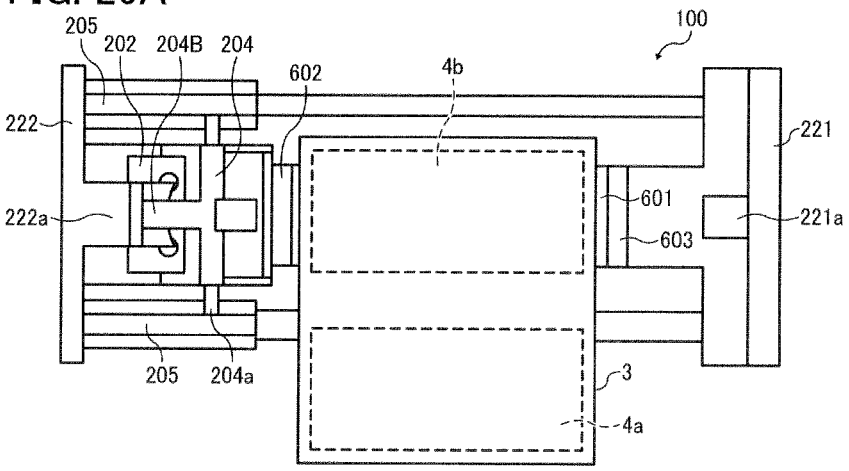
FIGS. 20A and 20B are plan views illustrating the effects of the droplet discharge sensor unit.
Figure 20B:
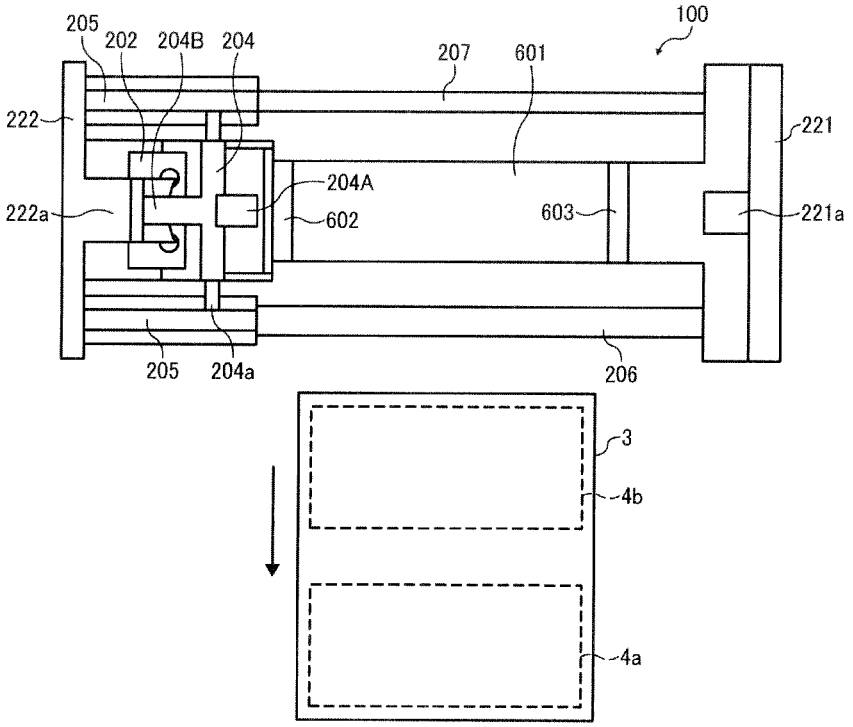

Next, as illustrated in FIG. 20B, the carriage 3 is moved and the recording head 4*b* is opposed to the resistor 601 of the droplet discharge sensor unit 100, so that droplet discharging property of each nozzle of the recording head 4*b* is detected.

Figure 21:
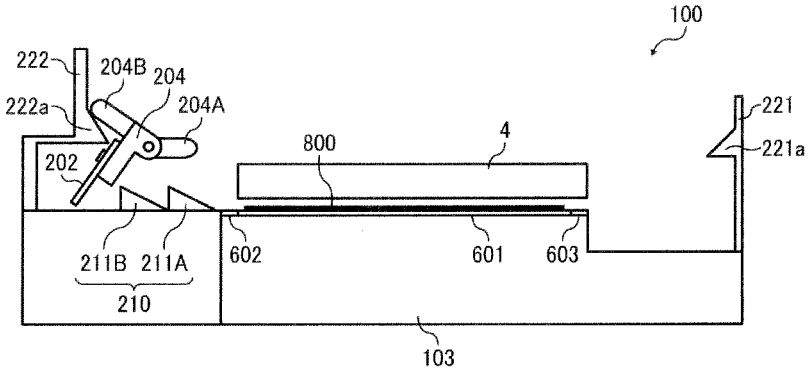
FIG. 21 is a side view illustrating the effects of the droplet discharge sensor unit.

Thus, by performing the discharge detection, droplets 800 are discharged on the resistor 601 as illustrated in FIG. 21.

At this time, the wiper 202 positions at a wiping end position and at a home position as illustrated in FIG. 21. Because the convex portion 204B of the holder 204 contacts the contact portion 222*a* and the convex portion 204B bounces up, so that the wiper 202 is kept in a state not contacting the resistor 601.

Figure 22A:
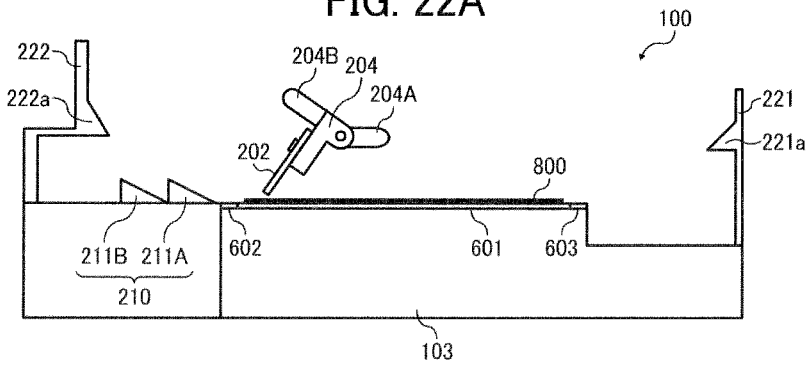
FIGS. 22A to 22C are plan views illustrating moving of the wiper of the droplet discharge sensor unit.
Figure 22B:
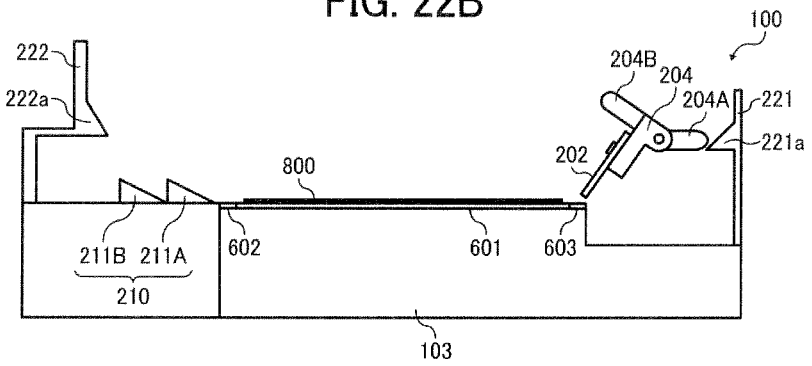
Figure 22C:
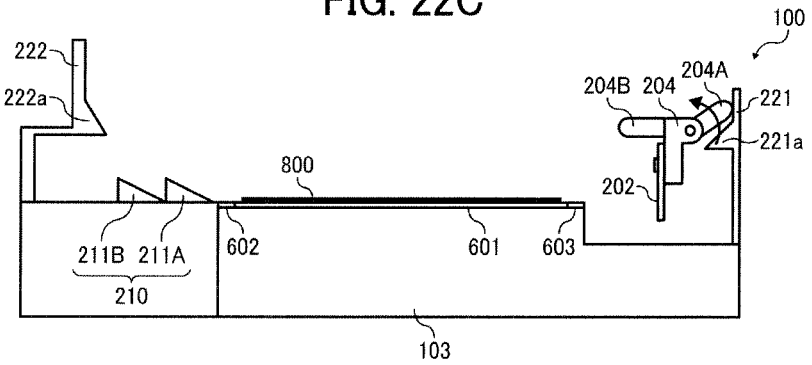

After the discharge detection, the lead screw 206 is rotated, and the wiper 202 is moved to the wiping start side keeping a posture not contacting the resistor 601 as illustrated in FIGS. 22A and 22B. When the wiper 202 arrives at a wiping start side as illustrated in FIG. 22C, because the convex portion 204A of the holder 204 contacts the contact portion 221*a* and the convex portion 204A bounces, the holder 204 rotates and the wiper 202 is brought to a state contacting to the resistor 601, that is, a posture in which wiping can be performed.

Figure 23A:
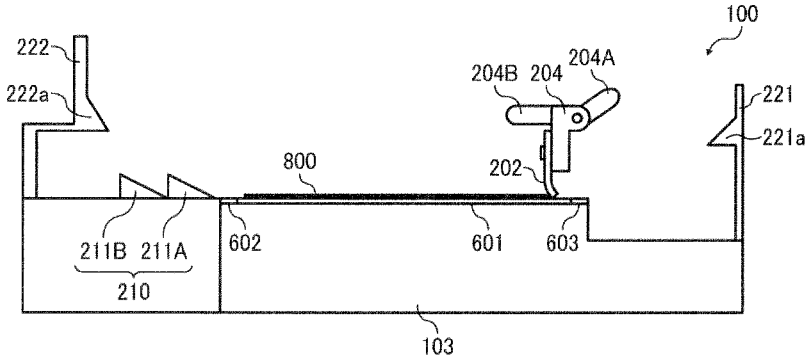
FIGS. 23A and 23B are also plan views.
Figure 23B:
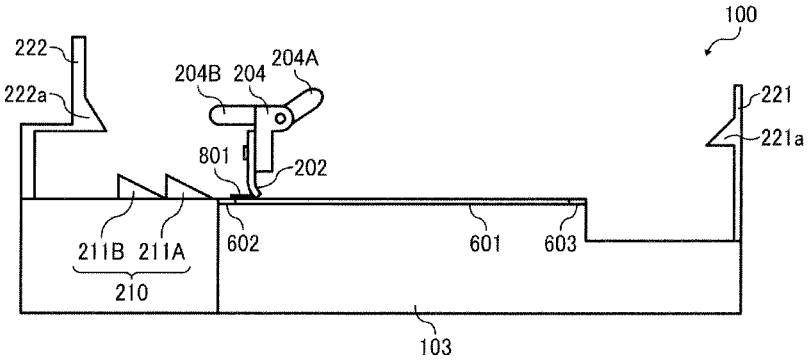

Then, the lead screw 206 is caused to rotate and the wiper 202 moves toward the wiping ending side as illustrated in FIGS. 23A and 23B, so that the droplets 800 on the resistor 601 is wiped by the wiper 202 and is gathered as a waste liquid 801. At this time, at the wiping end side, the wiping speed is slowed to prevent adhered waste liquid from scattering.

Figure 24A:
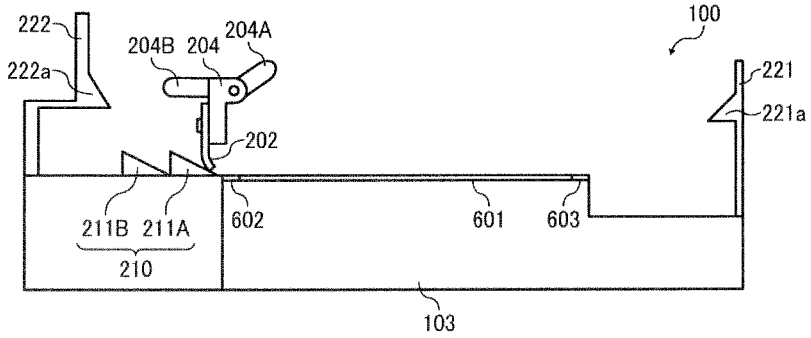
FIGS. 24A to 24C are also plan views.
Figure 24B:
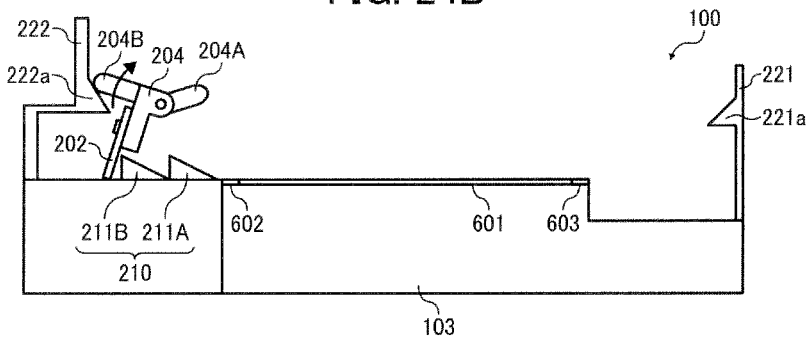
Figure 24C:
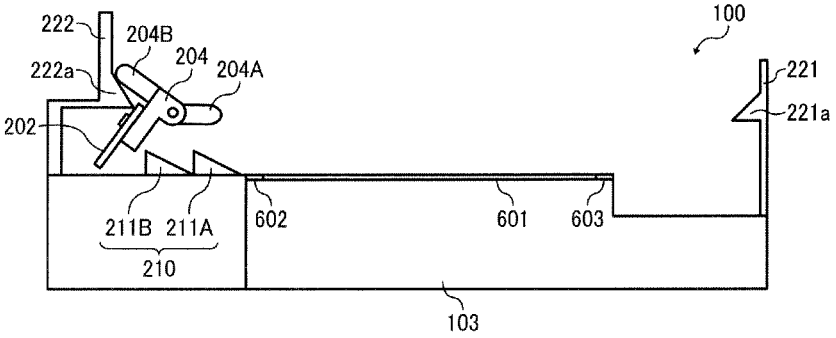

Further, when the wiper 202 moves to the wiping end side as illustrated in FIG. 24A, the waste liquid adhered on the wiper 202 is sequentially absorbed and removed by the absorbers 211A and 211B, so that the wiper 202 is cleaned. The wiping speed is lowered in the wiping end side and the waste liquid adhered on the wiper 202 is wiped off and the wiper 202 arrives at the wiping end side. Then, as illustrated in FIG. 24B, the convex portion 204B of the holder 204 contacts the contact portion 221*a* and bounces up. As illustrated in FIG. 24C, the holder 204 rotates, thereby bringing the wiper 202 to a posture not contacting the resistor 601.

In the present embodiment, after the discharge detection is performed on all nozzles in the nozzle rows Na and Nb of all recording heads 4*a* and 4*b*, the resistor 601 is wiped off; however, discharge detection and wiping can be performed each time the discharge detection of one recording head 4*a* or 4*b* ends.

However, in general, ink adhering amount to the resistor from one head is small and collecting ink into the waste tank is difficult. Therefore, it is more effective to clean the resistor after the discharge detection for all colors is complete, or further, discharge detection of all colors is complete several times because the waste liquid can be effectively collected.

Figure 25:
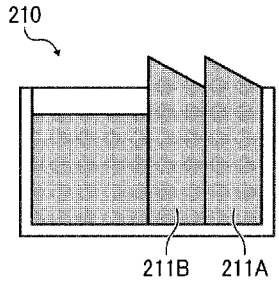
FIG. 25 is an explanatory view illustrating a wiper cleaner according to the first embodiment of the present invention.
Figure 26:
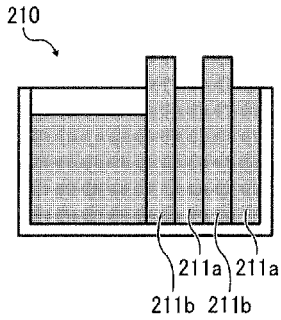
FIG. 26 is an explanatory view illustrating another exemplary wiper cleaner.

Different types of wiper cleaners will now be described with reference to FIGS. 25 and 26. FIGS. 25 and 26 are side views of the absorbers.

A first example in FIG. 25 is the absorber similar to the above-described embodiment. The portion of the absorbers 211A and 211B that contacts the wiper 202 includes a slanted shape, and the absorbers 211A and 211B are sequentially disposed. As a result, the surface of the absorbers 211A and 211B to contact the wiper 202 has convex and concave portions.

In this example, when the wiper 202 contacts the absorber 211A, the waste liquid adhered to the wiper 202 is absorbed by the absorber 211A. When the cleaning operation has been repeated many times, and the absorber 211A does not absorb the waste liquid anymore. The excess waste liquid that the absorber 211A does not absorb can be absorbed by the absorber 211B.

With this structure, the wiper can perform cleaning during a comparatively long term.

In the present embodiment, the absorber is configured to have two peaks with two absorbers 211A and 211B; however, the number of peaks can be increased in accordance with ink discharge amount for detection, frequency of discharge detection, lifetime of the apparatus or module, assumed environmental conditions, and amount of waste liquid to be absorbed.

Next, a second example of the absorber will be described referring to FIG. 26. Specifically, the second example includes a relatively short absorber 211*a* and a relatively tall absorber 211*b*, which are arranged alternately along the wipe-off direction. With this configuration, the contact surface of the absorbers with the wiper 202 includes convex and concave portions.

The number of convex and concave portions can be increased in accordance with the waste liquid amount to be absorbed.

Figure 27:
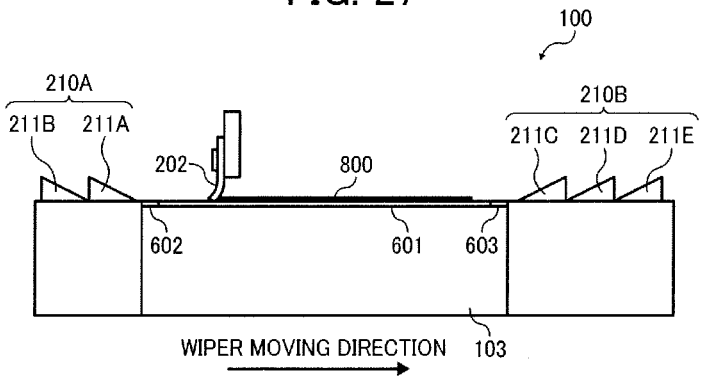
FIG. 27 is a side view of the droplet discharge sensor unit according to a second embodiment of the present invention, in which the wiper is wiping the resistor.

Next, the droplet discharge sensor unit in a third embodiment according to the present invention will be described with reference to FIGS. 27 through 28. FIGS. 27 and 23 are side views of the droplet discharge sensor unit.

In the third embodiment, a wiper cleaner 210A is disposed at one end of the nozzle alignment direction and a wiper cleaner 210B is disposed at another end. The wiper cleaner 210E serves as a cleanup means. The wiper cleaner 210A includes absorbers 211A and 211B and the wiper cleaner 210B includes absorbers 211C to 211E.

As illustrated in FIG. 27, when the wiper 202 is moved in the wiper moving direction as indicated by an arrow so as to wipe the resistor 601, the waste liquid adhered on the wiper 202 is absorbed and removed by the absorbers 211C to 211E through contacting between the wiper and the absorbers, so that the wiper 202 is cleaned up.

Figure 28:
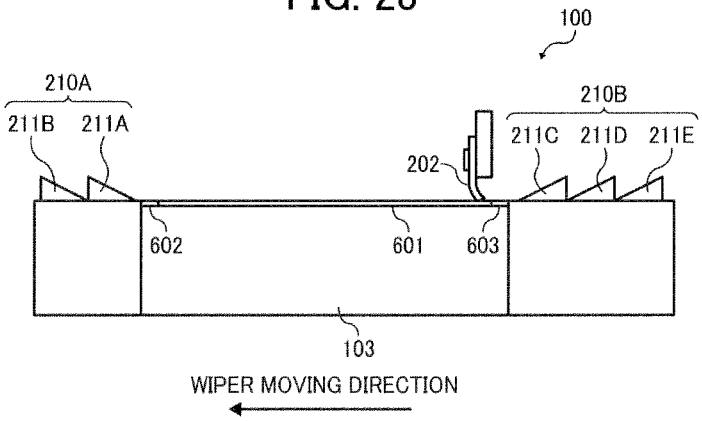
FIG. 28 is a side view of the droplet discharge sensor unit, in which the wiper is wiping the resistor in a direction reverse to that in FIG. 27.

Similarly, as illustrated in FIG. 28, when the wiper 202 is moved in the wiper moving direction, reverse to that in FIG. 27, as indicated by an arrow so as to wipe the resistor 601, the waste liquid adhered on the wiper 202 is absorbed and removed by the absorbers 211A and 211B through contacting between the wiper and the absorbers, so that the wiper 202 is cleaned up.

Specifically, in the present embodiment, the wiper 202 and the holder 204 do not rotate but instead move back and forth reciprocally in the sub-scanning direction.

Next, wiping directions of the wipers will now be described with reference to FIGS. 29 to 33. FIGS. 29 to 31 are explanatory views illustrating wiping directions as a comparative example, and FIGS. 32 and 33 are explanatory views illustrating wiping directions of the present embodiment.

Herein, description relates to a structure in which the wiper a (or the cleanup means) scrapes the waste liquid adhered on the wiper member.

First, in the comparative example as illustrated in FIGS. 29A to 29C and 30A to 30C, instead of the resistor 601, an electrode plate 1101 is used and voltage change of the electrode plate 1101 is detected. A wiper 1202 and a wiper cleaner 1111 is disposed along a longitudinal direction meaning a nozzle alignment direction.

Figure 29A:
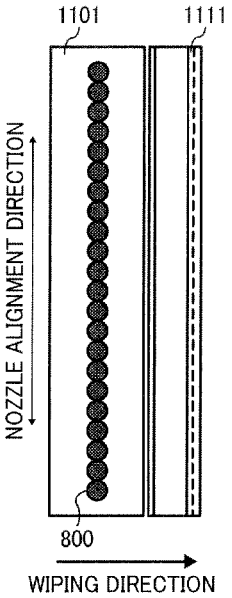
FIGS. 29A to 29C each are plan explanatory views illustrating wiping directions as a comparative example.
Figure 29B:
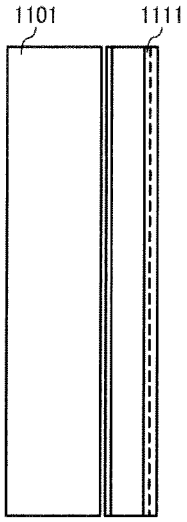
Figure 29C:
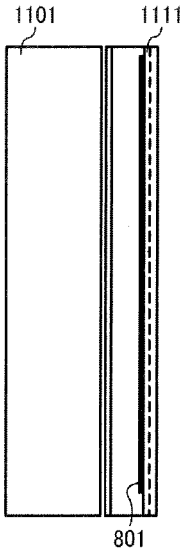
Figure 30A:
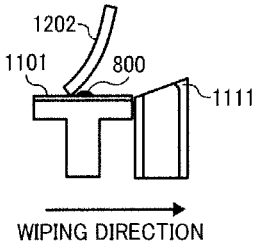
FIGS. 30A to 30C are front explanatory views illustrating wiping directions of the comparative example of FIGS. 29A to 29C.
Figure 30B:
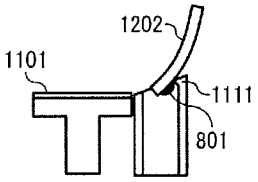
Figure 30C:
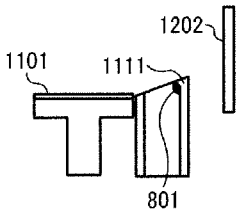
Figure 31:
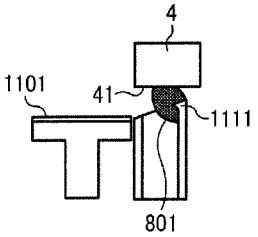
FIG. 31 is a front explanatory view of the comparative example of FIGS. 29A to 29C and FIGS. 30A to 30C.

As illustrated in FIGS. 29A and 30A, droplets 800 for discharge detection are discharged on the electrode plate 1101. Then, as illustrated in FIGS. 29B and 30B, the wiper 1202 is moved to the wiping direction perpendicular to the nozzle alignment direction and the droplets 800 on the electrode plate 1101 are wiped. The wiper 1202 further moves as illustrated in FIGS. 29C and 30C, and the waste liquid 801 adhered on the wiper 1202 is wiped by the wiper cleaner 1111.

Because the droplets 800 each are droplets with a minimum amount and are wiped in the direction at right angle to the nozzle alignment direction, the droplets 800 on the electrode plate 1101 do not form a mass. As a result, the waste liquid 801 is dispersed linearly and adheres along an edge of the wiper cleaner 1111.

As a result, the waste liquid 801 adhered at the edge of the wiper cleaner 1111 does not fall due to its own weight nor move even though absorbed forcibly, and agglomerates linearly there.

When a next discharge detection is performed in a state in which the waste liquid 801 agglomerates, the waste liquid adheres and agglomerates again to cover the already-agglomerated waste liquid 801.

When the waste liquid agglomerated at the edge of the wiper cleaner 1111 accumulates and develops, as illustrated in FIG. 21, the accumulated waste liquid interferes with the nozzle face 41 of the recording heads 4, resulting in a damage of a meniscus of the nozzle face 41 of the recording heads 4. As a result, reliable droplet discharge cannot be performed.

Figure 32A:
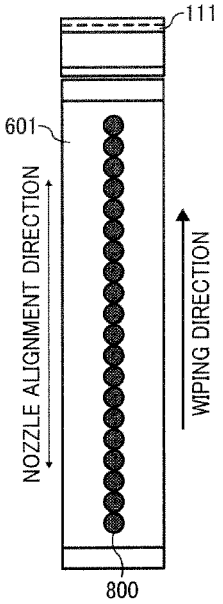
FIGS. 32A to 32C are explanatory views illustrating wiping directions of the present embodiment.
Figure 32B:
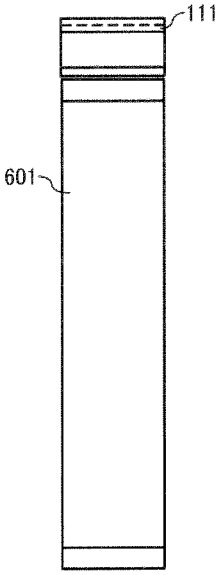
Figure 32C:
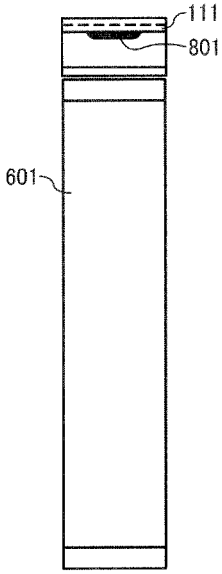
Figure 33A:
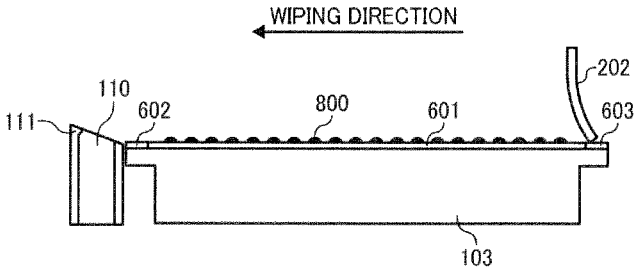
FIGS. 33A to 33C are explanatory side views of the present embodiment of FIGS. 32A to 32C.
Figure 33B:
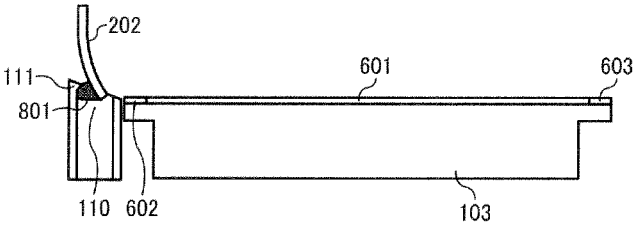

In contrast, droplets 800 for discharge detection are discharged on the resistor 601 as illustrated in FIGS. 32A and 33A. Then, as illustrated in FIGS. 32B and 33B, the wiper 202 is moved to the nozzle alignment direction and the droplets 800 on the resistor 601 are wiped. The wiper 202 further moves as illustrated in FIGS. 32C and 33C, and the waste liquid 801 adhered on the wiper 202 is wiped by a wiper cleaner 111.

Figure 33C:
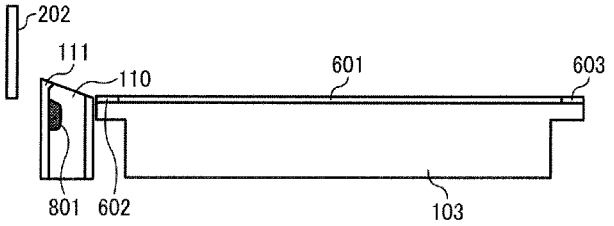

As illustrated in FIGS. 32C and 33C, the wiper 202 is moved to the nozzle alignment direction and the droplets 800 on the resistor 601 are wiped, so that the waste liquid 801 adhered to the wiper cleaner 111 is gathered in one place.

As a result, the waste liquid 801 adhered at the edge of the wiper cleaner 111 falls down due to its own weight and the agglomeration or accumulation of the waste liquid 801 at the edge of the wiper cleaner 111 can be reduced. As a result, when a suction operation is performed, the waste liquid can be easily discharged to a waste liquid tank.

Because the wiper and the electrode member are moved along the direction parallel to the nozzle alignment direction to thus clean the electrode member, the waste liquid is prevented from agglomerating or accumulating on the wiper and the cleaner to clean the wiper, and the degradation of the wiping property of the wiper over time can be restricted. With this structure, the droplet discharge detection can be performed with a higher precision.

Because the image forming apparatus according to the present invention includes a wiper and a cleanup means to remove the waste liquid adhered to the wiper, wiping property can be maintained for a long period.

The present invention was made considering the above problem, and provides a discharge detection with an uncomplicated structure with fewer detection errors.

The droplet discharge detection operation can be controlled by a computer via a program stored in the ROM of the computer. The program can be stored in a memory device and supplied via the memory device, or otherwise can be downloaded via a network such as the Internet.

In the present application, the term "sheet" is not limited to paper materials, but also includes an OHP sheet, fabrics, glass, board, and the like, on which ink droplets or other liquid can be adhered. The term "sheet" includes a recorded medium, recording medium, recording sheet, and the like. The term "image formation" means not only recording, but also printing, image printing, and the like.

The "image forming apparatus" means an apparatus to perform image formation by impacting ink droplets to various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply impacting the droplets to the medium).

The "ink" is not limited to so-called ink, but means and is used as an inclusive term for every liquid such as recording liquid, fixing liquid, and aqueous fluid to be used for image formation, which further includes, for example, DNA samples, registration and pattern materials and resins. For example, DNA sample, light-sensitive film, pattern material, and resins are included.

The term "image" is not limited to a plane two-dimensional one, but also includes a three-dimensional one, and the image formed by three-dimensionally from the 3D figure itself.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a recording head including a plurality of nozzles to discharge droplets; and a droplet discharge sensor unit to detect whether a droplet has been discharged from the plurality of nozzles of the recording head or not, the droplet discharge sensor unit comprising:

a resistor, on which the droplets discharged from the nozzles of the recording head lands, the resistor disposed opposite the recording head; and a sensor to detect a change in electrical resistance of the resistor when the droplets discharged from the plurality of nozzles of the recording head landed on the resistor, wherein the droplet discharge sensor unit further comprises electrodes disposed at opposed ends of the resistor in a nozzle array width direction, outside the plurality of nozzles at both ends in the nozzle array width direction, and detects a change in the resistance between the electrodes.

2. The image forming apparatus as claimed in claim 1, further comprising a control circuit to determine a volume of the discharged droplets landed on the resistor from the change in the resistance of the resistor.

3. The image forming apparatus as claimed in claim 1, further comprising a control circuit to count time from the droplet discharge until a change in the resistance is detected.

4. The image forming apparatus as claimed in claim 1, further comprising a cleaning unit to clean a droplet landed surface of the resistor, wherein the cleaning unit includes a wiper to wipe a droplet landed on the resistor and cleans the wiper by moving the wiper relative to the resistor.

5. The image forming apparatus as claimed in claim 4, further comprising a holder to hold the wiper, movable between a first position in which the wiper is brought to a posture to wipe the resistor and a second position in which the wiper is separated from the resistor;

a first contact member disposed at wiping start side of the wiper; and a second contact member disposed at a wiping end side of the wiper, wherein the holder is brought to the first position by contacting the first contact member and is brought to the second position by contacting the second contact member.

6. The image forming apparatus as claimed in claim 4, wherein a receding contact angle of a surface of the resistor is greater than a receding contact angle of a surface of the wiper.

7. The image forming apparatus as claimed in claim 4, wherein the resistor is formed of a material with a stiffness greater than that of the wiper.

8. The image forming apparatus as claimed in claim 1, wherein the resistor is a carbon film resistor.

9. A droplet discharge sensor unit for an image forming apparatus having a recording head including a plurality of nozzles, wherein the droplet discharge sensor unit detects whether a droplet has been discharged from the plurality of nozzles of the recording head or not and includes a resistor on which the droplets discharged from the plurality of nozzles of the recording head lands, wherein the droplet discharge sensor unit detects a change in electrical resistance of the resistor when the droplets discharged from the plurality of nozzles of the recording head landed on the resistor, and wherein the droplet discharge sensor unit further comprises electrodes disposed at opposed ends of the resistor in a nozzle array width direction, outside the plurality of nozzles at both ends in the nozzle array width direction, and detects a change in the resistance between the electrodes.

* * * * *